US009962804B2

(12) United States Patent
Shinozaki

(10) Patent No.: US 9,962,804 B2
(45) Date of Patent: May 8, 2018

(54) POLISHING APPARATUS, METHOD FOR CONTROLLING THE SAME, AND METHOD FOR OUTPUTTING A DRESSING CONDITION

(71) Applicant: EBARA CORPORATION, Tokyo (JP)

(72) Inventor: Hiroyuki Shinozaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 148 days.

(21) Appl. No.: 15/071,091

(22) Filed: Mar. 15, 2016

(65) Prior Publication Data

US 2016/0271749 A1 Sep. 22, 2016

(30) Foreign Application Priority Data

Mar. 19, 2015 (JP) ..... 2015-056922

(51) Int. Cl.
*B24B 37/00* (2012.01)
*B24B 37/005* (2012.01)

(52) U.S. Cl.
CPC ..... *B24B 37/005* (2013.01)

(58) Field of Classification Search
CPC ... B24B 37/005; B24B 53/005; B24B 53/017; B24B 53/00; B24B 53/08
USPC ..... 451/5, 21, 26, 56, 443
See application file for complete search history.

(56) References Cited

U.S. PATENT DOCUMENTS 9,108,292 B2 * 8/2015 Shimano ..... B24B 53/005
9,156,130 B2 * 10/2015 Shimano ..... B24B 37/005
9,469,013 B2 * 10/2016 Tanikawa ..... B24B 49/006
2004/0242122 A1 * 12/2004 Kramer ..... B24B 49/10 451/5
2008/0070479 A1 * 3/2008 Nabeya ..... B24B 37/30 451/8
2008/0146119 A1 * 6/2008 Sasaki ..... B24B 37/30 451/5
2010/0081361 A1 4/2010 Fukuda et al.
2011/0159783 A1 * 6/2011 Fukushima ..... B24B 37/042 451/11
2013/0122783 A1 * 5/2013 Menk ..... B24B 37/042 451/11

FOREIGN PATENT DOCUMENTS

JP 09-300207 A 11/1997
JP 2010-076049 A 4/2010

* cited by examiner

*Primary Examiner* — George Nguyen
(74) *Attorney, Agent, or Firm* — Baker & Hostetler LLP

(57) ABSTRACT

A polishing apparatus includes: a turntable for supporting a polishing pad; a turntable rotation mechanism configured to rotate the turntable; a dresser configured to dress the polishing pad; and a scanning mechanism configured to cause the dresser to scan between a first position and a second position on the polishing pad, wherein Ttt/Tds and Tds/Ttt are a non-integer where the Ttt is a rotation cycle of the turntable during dressing, and the Tds is a scanning cycle during which the dresser scans between the first position and the second position.

27 Claims, 9 Drawing Sheets

Ttt／Tds=2

Ttt／Tds=1

Ttt／Tds=0.5

FIG.4A Tds／Ttt=1.5(N=2)
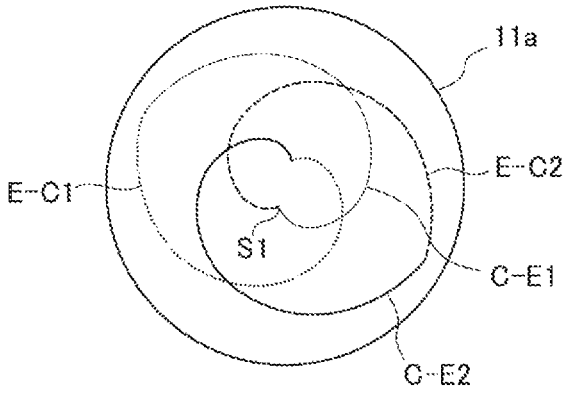
FIG.4B Tds／Ttt=2.5(N=2)
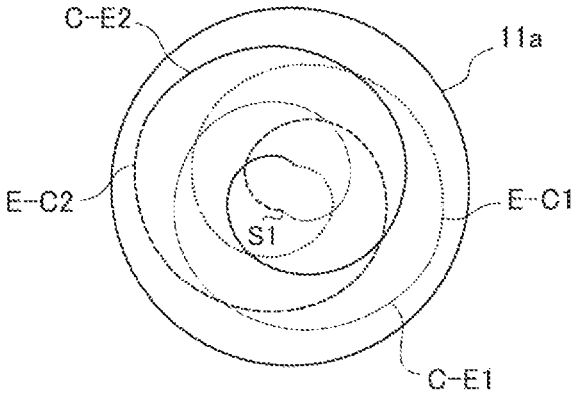
FIG.4C Tds／Ttt=1.25(N=4)
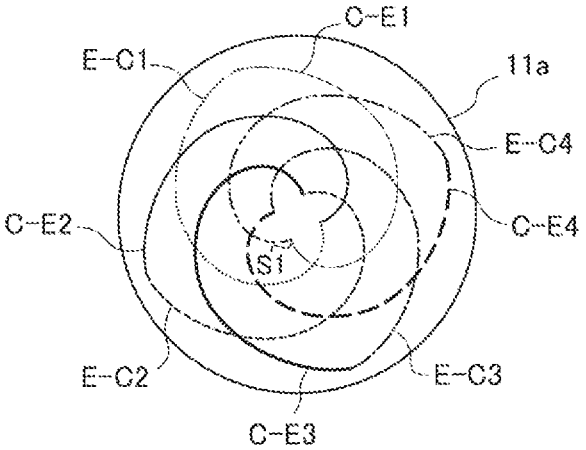

FIG.6A Tds／Ttt=1.32
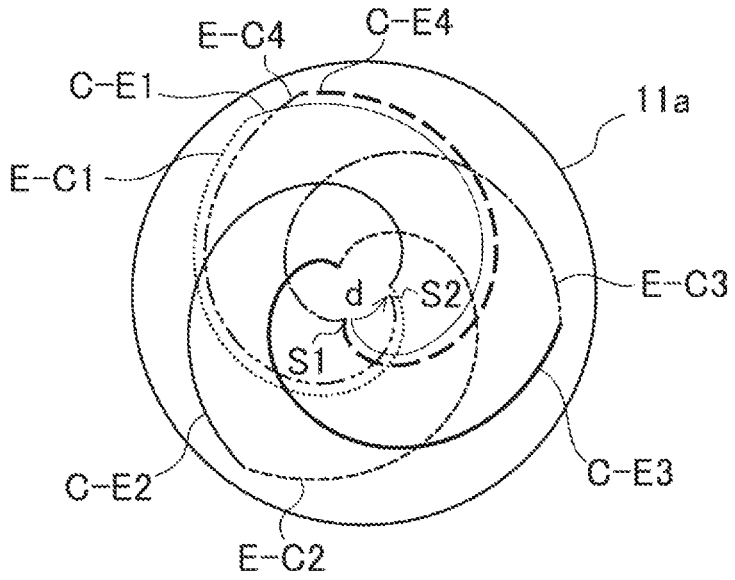
FIG.6B Tds／Ttt=1.68
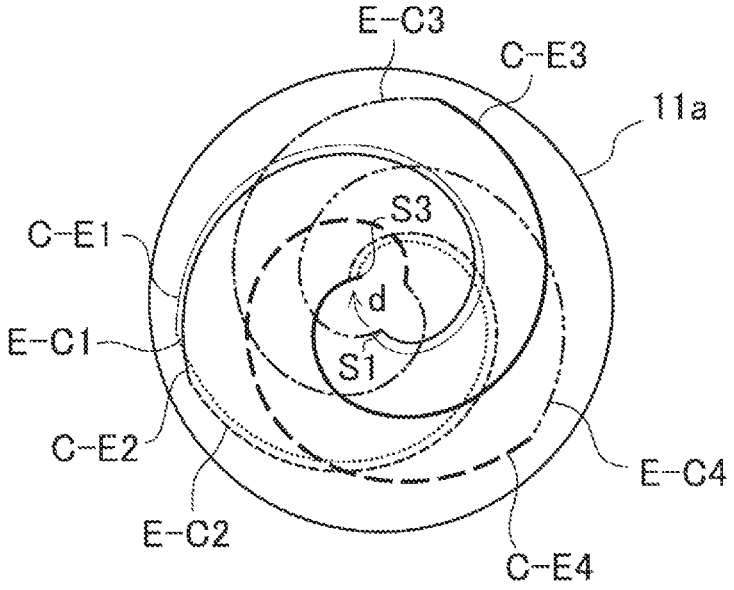

POLISHING APPARATUS, METHOD FOR CONTROLLING THE SAME, AND METHOD FOR OUTPUTTING A DRESSING CONDITION

CROSS-REFERENCE TO RELATED APPLICATIONS

This application claims the benefit of Japanese Priority Patent Application JP 2015-056922 filed on Mar. 19, 2015, the entire contents of which are incorporated herein by reference.

FIELD

The present art relates generally to a polishing apparatus including a dresser for a polishing pad, a method for controlling the same, and method for outputting a dressing condition.

BACKGROUND AND SUMMARY

A polishing apparatus represented by a chemical mechanical polishing (CMP) apparatus polishes a substrate surface by relatively moving both of a polishing pad and the substrate surface to be polished in a contacted state. Consequently, the polishing pad is gradually worn away, and fine roughness on a surface of the polishing pad is crushed, which may decrease a polishing rate. Therefore, the fine roughness needs to be reformed on the polishing pad surface by dressing the polishing pad surface by a dresser in which a plurality of diamond particles is electrically deposited on a surface and a dresser having a brush on a surface (for example, JP 9-300207 A and JP 2010-76049 A).

Conventionally, dressing is usually performed by using a dresser having a size which can cover a whole polishing pad (for example, JP 9-300207 A). However, in recent years, a substrate is increased in size, and to prevent a related increase in size of a polishing apparatus to the extent possible, a small-sized dresser is used (for example JP 2010-76049 A). In the case where a dresser is smaller than a polishing pad, there is a problem that it is difficult to uniform the polishing pad.

Therefore, it is desirable to provide a polishing apparatus capable of uniforming a polishing pad by a small dresser, a method for controlling the same, and a dressing condition output method.

According to one embodiment, a polishing apparatus includes: a turntable for supporting a polishing pad; a turntable rotation mechanism configured to rotate the turntable; a dresser configured to dress the polishing pad; and a scanning mechanism configured to cause the dresser to scan between a first position and a second position on the polishing pad, wherein Ttt/Tds and Tds/Ttt are a non-integer where the Ttt is a rotation cycle of the turntable during dressing, and the Tds is a scanning cycle during which the dresser scans between the first position and the second position.

According to another embodiment, a polishing apparatus including: a turntable for supporting a polishing pad; a turntable rotation mechanism configured to rotate the turntable; a dresser configured to dress the polishing pad; a pressing mechanism configured to press the dresser against the polishing pad; and a scanning mechanism configured the dresser to scan between a first position and a second position of the polishing pad, wherein V(t)A(t)/r(t) is substantially constant where the V(t) is a relative speed between the dresser and the polishing pad at a time t, the r(t) is a distance between a center of the turntable and a center of the dresser at a time t, and the A(t) is a pressing force or a pressure of the dresser against the polishing pad at a time t.

According to another embodiment, a control method for a polishing apparatus, the method including: providing a turntable for supporting a polishing pad, a turntable rotation mechanism, a dresser, a scanning mechanism, and a controller; and controlling the turntable rotation mechanism and the scanning mechanism such that Ttt/Tds and Tds/Ttt become non-integers in a case where a rotation cycle of the turntable during dressing is denoted by Ttt, and a scanning cycle in which the dresser scans between a first position and a second position on the polishing pad is denoted by Tds.

According to another embodiment, a control method for a polishing apparatus, the method including: providing a turntable for supporting a polishing pad, a turntable rotation mechanism, a dresser, a pressing mechanism, a scanning mechanism, and a controller; and controlling the turntable rotation mechanism, the pressing mechanism, and the scanning mechanism such that V(t)A(t)/r(t) becomes substantially constant where the V(t) is a relative speed between the dresser and the polishing pad at a time t, the r(t) is a distance between a center of the turntable and a center of the dresser at a time t, and the A(t) is a pressing force or a pressure of the dresser against the polishing pad at a time t.

According to another embodiment, a dressing condition output method for a polishing apparatus, the method including: preparing a turntable for supporting a polishing pad, a turntable rotation mechanism a dresser, a scanning mechanism, and a controller; receiving a restriction condition; first referring to a database previously storing a first condition which is a dressing condition capable of uniformly dressing the polishing pad and a second condition which is a dressing condition incapable of uniformly dressing the polishing pad, and outputting the first condition in a case where the first condition satisfying the restriction condition is stored in the database; calculating a dressing condition in a case where the first condition satisfying the restriction condition is not stored; and second referring to the database to output the calculated dressing condition in a case where the calculated dressing condition and the second condition are not matched, wherein, upon calculating the dressing condition, the dressing condition is calculated such that Ttt/Tds and Tds/Ttt become non-integers where the Ttt is a rotation cycle of the turntable during dressing, and the Tds is a scanning cycle during which the dresser scans between a first position and a second position on the polishing pad.

According to another embodiment, a method for outputting a dressing condition for a polishing apparatus, the method including: supplying a turntable for supporting a polishing pad, a turntable rotation mechanism, a dresser, a pressing mechanism, a scanning mechanism, and a controller; and receiving a restriction condition; first referring to a database preliminary storing the first condition which is a dressing condition capable of uniformly dressing the polishing pad and a second condition which is a dressing condition incapable of uniformly dressing the polishing pad, and outputting a first condition in a case where the first condition satisfying the control condition is stored in the database; calculating a dressing condition in a case where the first condition satisfying the restriction condition is not stored; and second referring to the database to output the calculated dressing condition in a case where the calculated dressing condition and the second condition are not matched, wherein, upon calculating the dressing condition, the dressing condition is calculated such that V(t)A(t)/r(t)

becomes substantially constant where the V(t) is a relative speed between the dresser and the polishing pad at a time t, the r(t) is a distance between a center of the turntable and a center of the dresser at a time t, and the A(t) is a pressing force or a pressure of the dresser against the polishing pad at a time t.

BRIEF DESCRIPTION OF DRAWINGS

FIGS. 4A to 4C are views illustrating loci of the dresser 51 on the polishing pad 11*a*.

FIGS. 6A and 6B are views illustrating loci of the dresser 51 on the polishing pad 11*a*.

DETAILED DESCRIPTION OF NON-LIMITING EXAMPLE EMBODIMENTS

Figure 1:
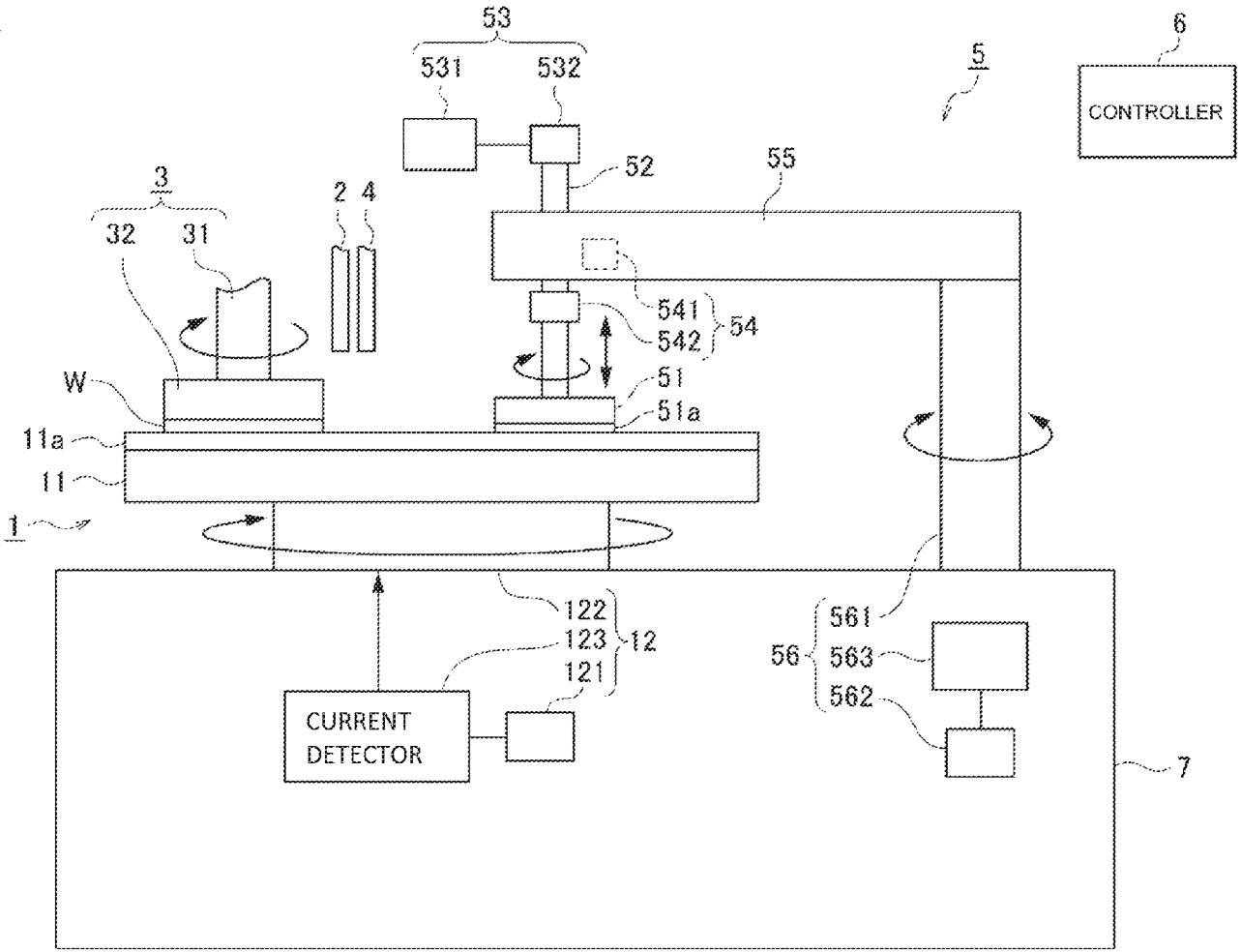
FIG. 1 is a schematic view illustrating a schematic configuration of a polishing apparatus.

The description will be given below by using drawings.

According to one embodiment, a polishing apparatus includes: a turntable for supporting a polishing pad; a turntable rotation mechanism configured to rotate the turntable; a dresser configured to dress the polishing pad; and a scanning mechanism configured to cause the dresser to scan between a first position and a second position on the polishing pad, wherein Ttt/Tds and Tds/Ttt are a non-integer where the Ttt is a rotation cycle of the turntable during dressing, and the Tds is a scanning cycle during which the dresser scans between the first position and the second position.

Ttt/Tds and Tds/Ttt are non-integers. Therefore, loci of a dresser do not overlap, and a polishing pad can be made uniform.

Preferably, the apparatus further includes a controller configured to set the Ttt and/or the Tds.

Accordingly, a relation between Ttt and Tds can be appropriately controlled.

Preferably, Tds/Ttt=n+1/N (n is any integer) is satisfied where the N is a number of times for which the dresser scans on the polishing pad during dressing once.

Accordingly, a same portion on a polishing pad is not polished during N scanning times, and thus a polishing pad can be efficiently dressed by limited scanning times.

Preferably, $Tds/Ttt=n\pm d/2\pi r0$ is established (n is any integer) where the d is a diameter of the dresser, and the r0 is a distance from a starting point of the dresser in scanning to a center of the turntable.

Accordingly, the dresser scans while shifting by its diameter d. Therefore, an undressed region can be decreased in a circumferential direction of the polishing pad.

Preferably, in a case where a diameter of the dresser is denoted by d, the n is selected such that an average scanning speed of the dresser is closest to d/Ttt.

Accordingly, an undressed portion can be decreased in a radial direction of the polishing pad.

Preferably, the dresser dresses the polishing pad during a period after polishing one substrate is completed and before a next substrate is started to be polished, and the Tds is set such that the dresser scans on the polishing pad for a first times or more during the period.

Accordingly, sufficient polishing frequency can be secured in a period.

Preferably, the dresser dresses the polishing pad in parallel with that polishing the substrate, and the Ttt is set in accordance with a polishing condition of the substrate.

Accordingly, a polishing condition of a substrate and a dressing condition of a polishing pad can be compatible.

Preferably, the scanning mechanism causes the dresser to scan from a neighborhood of a center on the polishing pad as a starting point.

Accordingly, an undressed region near a center of the polishing pad can be decreased.

Preferably, the apparatus further includes a pressing mechanism configured to press the dresser against the polishing pad, wherein V(t)A(t)/r(t) is substantially constant where the V(t) is a relative speed between the dresser and the polishing pad at a time t, the r(t) is a distance between a center of the turntable and a center of the dresser at a time t, and the A(t) is a pressing force or a pressure of the dresser against the polishing pad at a time t.

Accordingly, a polishing amount by the polishing pad becomes constant regardless of a dresser position.

According to another embodiment, a polishing apparatus including: a turntable for supporting a polishing pad; a turntable rotation mechanism configured to rotate the turntable; a dresser configured to dress the polishing pad; a pressing mechanism configured to press the dresser against the polishing pad; and a scanning mechanism configured the dresser to scan between a first position and a second position of the polishing pad, wherein V(t)A(t)/r(t) is substantially constant where the V(t) is a relative speed between the dresser and the polishing pad at a time t, the r(t) is a distance between a center of the turntable and a center of the dresser at a time t, and the A(t) is a pressing force or a pressure of the dresser against the polishing pad at a time t.

Accordingly, a polishing amount by the polishing pad becomes constant regardless of a dresser position.

Preferably, the apparatus further includes a controller configured to control the V(t) and/or the A(t) such that V(t)A(t)/r(t) becomes substantially constant.

Accordingly, a relation between V(t) and A(t) can be appropriately controlled.

Preferably, the apparatus further includes a controller configured to control the V(t) and/or the A(t) such that a friction coefficient between the dresser and the polishing pad becomes constant.

Accordingly, a friction coefficient between a dresser and a polishing pad becomes constant, and the polishing pad can be made uniform.

Preferably, the controller calculates the friction coefficient based on the V(t), the A(t), and a force to actually dress the polishing pad by the dresser.

Accordingly, control such that the friction coefficient becomes constant can be possible.

Preferably, the apparatus further includes a controller configured to rotate the turntable by controlling the turntable rotation mechanism and cause the dresser to scan by controlling the scanning mechanism in a state in which the dresser does not come into contact with the polishing pad, to monitor a locus of the dresser on the polishing pad in a state in which the dresser does not come into contact with the polishing pad.

Accordingly, it is possible to confirm whether the polishing pad can be actually uniformly dressed without being worn away under a set condition.

According to another embodiment, a control method for a polishing apparatus, the method including: providing a turntable for supporting a polishing pad, a turntable rotation mechanism, a dresser, a scanning mechanism, and a controller; and controlling the turntable rotation mechanism and the scanning mechanism such that Ttt/Tds and Tds/Ttt become non-integers in a case where a rotation cycle of the turntable during dressing is denoted by Ttt, and a scanning cycle in which the dresser scans between a first position and a second position on the polishing pad is denoted by Tds.

According to another embodiment, a control method for a polishing apparatus, the method including: providing a turntable for supporting a polishing pad, a turntable rotation mechanism, a dresser, a pressing mechanism, a scanning mechanism, and a controller; and controlling the turntable rotation mechanism, the pressing mechanism, and the scanning mechanism such that V(t)A(t)/r(t) becomes substantially constant where the V(t) is a relative speed between the dresser and the polishing pad at a time t, the r(t) is a distance between a center of the turntable and a center of the dresser at a time t, and the A(t) is a pressing force or a pressure of the dresser against the polishing pad at a time t.

According to another embodiment, a dressing condition output method for a polishing apparatus, the method including: preparing a turntable for supporting a polishing pad, a turntable rotation mechanism a dresser, a scanning mechanism, and a controller; receiving a restriction condition; first referring to a database previously storing a first condition which is a dressing condition capable of uniformly dressing the polishing pad and a second condition which is a dressing condition incapable of uniformly dressing the polishing pad, and outputting the first condition in a case where the first condition satisfying the restriction condition is stored in the database; calculating a dressing condition in a case where the first condition satisfying the restriction condition is not stored; and second referring to the database to output the calculated dressing condition in a case where the calculated dressing condition and the second condition are not matched, wherein, upon calculating the dressing condition, the dressing condition is calculated such that Ttt/Tds and Tds/Ttt become non-integers where the Ttt is a rotation cycle of the turntable during dressing, and the Tds is a scanning cycle during which the dresser scans between a first position and a second position on the polishing pad.

Accordingly, self-control of the polishing apparatus becomes possible and a dressing condition can be efficiently obtained.

According to another embodiment, a method for outputting a dressing condition for a polishing apparatus, the method including: supplying a turntable for supporting a polishing pad, a turntable rotation mechanism, a dresser, a pressing mechanism, a scanning mechanism, and a controller; and receiving a restriction condition; first referring to a database preliminary storing the first condition which is a dressing condition capable of uniformly dressing the polishing pad and a second condition which is a dressing condition incapable of uniformly dressing the polishing pad, and outputting a first condition in a case where the first condition satisfying the control condition is stored in the database; calculating a dressing condition in a case where the first condition satisfying the restriction condition is not stored; and second referring to the database to output the calculated dressing condition in a case where the calculated dressing condition and the second condition are not matched, wherein, upon calculating the dressing condition, the dressing condition is calculated such that V(t)A(t)/r(t) becomes substantially constant where the V(t) is a relative speed between the dresser and the polishing pad at a time t, the r(t) is a distance between a center of the turntable and a center of the dresser at a time t, and the A(t) is a pressing force or a pressure of the dresser against the polishing pad at a time t.

Accordingly, self-control of the polishing apparatus becomes possible and a dressing condition can be efficiently obtained.

Preferably, the method further includes adding the calculated dressing condition to the database in a case where the calculated dressing condition and the second condition are not matched.

Accordingly, database can be further enriched.

Preferably, the method further includes, in a case where the calculated dressing condition and the second condition are not matched, rotating the turntable by controlling the turntable rotation mechanism and causing the dresser to scan by controlling the scanning mechanism in a state in which the dresser does not come into contact with the polishing pad and under the calculated dressing condition, to confirm by monitoring a locus of the dresser on the polishing pad whether or not dressing the polishing pad uniformly is possible, wherein if possible to dress the polishing pad uniformly as a result of a confirmation, the controller outputs the calculated dressing condition.

Accordingly, it is possible to output a dressing condition after confirming whether the polishing pad can be actually uniformly dressed without being worn away under a set condition.

Preferably, the method further includes calculating other dressing condition in a case where the calculated dressing condition and the second condition are matched.

Accordingly, an appropriate dressing condition can be output.

First Embodiment

FIG. 1 is a schematic view illustrating a schematic configuration of a polishing apparatus. The polishing apparatus polishes a substrate W such as a semiconductor wafer and includes a table unit 1, a polishing liquid supply nozzle 2, a polishing unit 3, a dressing liquid supply nozzle 4, a dressing unit 5, and a controller 6. The table unit 1, the polishing unit 3, and the dressing unit 5 are disposed on a base 7.

The table unit 1 includes a turntable 11 and a turntable rotation mechanism 12 for rotating the turntable 11. A cross section of the turntable 11 is a circle, and the polishing pad 11*a* is supported by the turntable 11, that is, fixed on an upper surface of the turntable 11. The substrate is polished by contacting with the polishing pad. A cross section of the polishing pad 11*a* is a circle as well as the cross section of the turntable 11. The turntable rotation mechanism 12 includes a turntable motor driver 121, a turntable motor 122, and a current detector 123. The turntable motor driver 121 supplies a driving current to the turntable motor 122. The turntable motor 122 is connected to the turntable 11 and rotates the turntable 11 by the driving current. The current detector 123 detects a driving current value. As a driving current is increased, torque of the turntable 11 is increased.

Therefore, the torque of the turntable 11 can be calculated based on the driving current value.

When a rotation cycle and a rotation speed of the turntable 11 are respectively denoted by Ttt[s] and Ntt[rpm], a relation of Ttt=60/Ntt is satisfied. The rotation cycle Ttt (or the rotation speed Ntt) can be controlled by adjusting a driving current by the controller 6.

The polishing liquid supply nozzle 2 supplies polishing liquid such as slurry on the polishing pad 11*a*.

The polishing unit 3 includes a top ring shaft 31, and a top ring 32 connected to a lower end of the top ring shaft 31. The top ring 32 holds the substrate W on a lower surface by vacuum suction. The top ring shaft 31 rotates by a motor (not illustrated), and accordingly the top ring 32 and the held substrate W rotate. Further, the top ring shaft 31 moves up and down with respect to the polishing pad 11*a* by a vertical movement mechanism (not illustrated) including a servo motor and a ball screw, for example.

The substrate W is polished as described below. While polishing liquid is supplied on the polishing pad 11*a* from the polishing liquid supply nozzle 2, each of the top ring 32 and the turntable 11 is rotated. In this state, the top ring 32 holding the substrate W is lowered, and the substrate W is pressed on an upper surface of the polishing pad 11*a*. The substrate W and the polishing pad 11*a* are in slide contact with each other in the presence of polishing liquid. Thus, a surface of the substrate W is polished and flattened. At this time, the rotation cycle Ttt of the turntable 11 is set in accordance with a polishing condition.

The dressing liquid supply nozzle 4 supplies dressing liquid such as deionized water on the polishing pad 11*a*.

The dressing unit 5 includes the dresser 51, a dresser shaft 52, a pressing mechanism 53, a dresser rotation mechanism 54, a dresser arm 55, and a scanning mechanism 56.

A cross section of the dresser 51 is a circle, and a lower surface of the dresser 51 is a dressing surface. The dressing surface is formed by a dress disc 51*a* on which diamond particles are fixed. The dresser 51 dresses (conditions) the polishing pad 11*a* by polishing a surface of the polishing pad 11*a* in a state in which the dress disc 51*a* comes into contact with the polishing pad 11*a*.

A lower end of the dresser shaft 52 is connected to the dresser 51, and an upper end thereof is connected to the pressing mechanism 53.

The pressing mechanism 53 moves the dresser shaft 52 up and down. When the dresser shaft 52 moves down, the dresser 51 is pressed against the polishing pad 11*a*. As a specific configuration example, the pressing mechanism 53 includes an electropneumatic regulator 531 for generating a predetermined pressure and a cylinder 532 provided on an upper portion of the dresser shaft 52 and for moving the dresser shaft 52 up and down by the generated pressure.

A pressing force F[N] of the dresser 51 against the polishing pad 11*a* is controlled by controlling the pressing mechanism 53 by the controller 6. For example, the pressing force F is controlled by adjusting a pressure P [$N/m^2$] generated by the electropneumatic regulator 531 by the controller 6. Alternatively, by setting the pressure P generated by the electropneumatic regulator 531 constant, and adjusting an angle for tilting the dresser shaft 52 by the controller 6, the pressing force F in a vertical direction is controlled. According to the latter control, the pressing force F can be controlled without being affected by hysteresis while moving the dresser shaft 52 up and down.

The dresser rotation mechanism 54 includes a dresser motor driver 541 and a dresser motor 542. The dresser motor driver 541 supplies a driving current to the dresser motor 542. The dresser motor 542 is connected to the dresser shaft 52 and rotates the dresser shaft 52 by the driving current, and accordingly the dresser 51 rotates.

A rotation speed Nd[rpm] of the dresser 51 can be controlled by adjusting the driving current by the controller 6.

One end of the dresser arm 55 rotatably supports the dresser shaft 52. Further, another end of the dresser arm 55 is connected to the scanning mechanism 56.

The scanning mechanism 56 includes a spindle 561, a swinging motor driver 562, and a swinging motor 563 and causes the dresser 51 to scan on the polishing pad 11*a*. In other words, an upper end of the spindle 561 is connected to the other end of the dresser arm 55, and a lower end is connected to the swinging motor 563. The swinging motor driver 562 supplies a driving current to the swinging motor 563. The swinging motor 563 rotates the spindle 561 by the driving current. Accordingly, the dresser 51 swings between a center and an edge on the polishing pad 11*a*. Further, the scanning mechanism 56 detects a position and a swinging direction of the dresser 51 on the polishing pad 11*a* by a detector (not illustrated) such as a displacement sensor and an encoder.

A scanning cycle Tds[s] of the dresser 51 (round-trip time in which the dresser 51 moves from a center to an edge of the polishing pad 11*a* and returns to the center) can be controlled by commanding to the swinging motor driver 562 based on a section and a speed setting for scan shifting in a previously set dresser recipe by the controller 6.

Dressing of the polishing pad 11*a* is performed as described below. While supplying dressing liquid on the polishing pad 11*a* from the dressing liquid supply nozzle 4, the turntable rotation mechanism 12 rotates the turntable 11, the dresser rotation mechanism 54 rotates the dresser 51, and the scanning mechanism 56 causes the dresser 51 to scan. In this state, the pressing mechanism 53 presses the dresser 51 against a surface of the polishing pad 11*a* to cause the dress disc 51*a* slide on a surface of the polishing pad 11*a*. The surface of the polishing pad 11*a* is scraped off by the rotating dresser 51, and accordingly the surface is dressed.

The controller 6 controls a whole polishing apparatus. As described above, the controller 6 controls a rotation cycle Ttt (rotation speed Ntt) of the turntable 11, a rotation speed Nd and a scanning cycle Tds of the dresser 51. The controller 6 may be a computer and may perform control to be described below by executing a predetermined program.

As described above, a polishing apparatus performs polishing processing of the substrate W and dressing processing of the polishing pad 11*a*. As timing of these two processes, for example, the following serial processing and parallel processing are considered.

In the serial processing, dressing is performed in a period after finishing polishing one substrate W and before starting polishing the following substrate W. In other words, in the serial processing, polishing of the substrate W and dressing of the polishing pad 11*a* are performed separately. Therefore, a dressing condition can be freely set separately from a polishing condition of the substrate W. However, the time period in which dressing is performed is overhead time because the substrate W is not being processed. Therefore, this time period is preferably as short as possible, and the dressing is restrictively performed in a short time.

In the parallel process, while polishing the substrate W at a certain position on the polishing pad 11*a*, dressing is performed at another position. In other words, in the parallel processing, polishing of the substrate W and dressing of the polishing pad 11*a* are performed in parallel. Therefore, the overhead time can be shortened since there is no time in which only dressing of the polishing pad 11*a* is performed. However, the dressing is performed under a polishing condition of the substrate W. Therefore, flexibility of a dressing condition is restrictively reduced.

In any processing, the controller 6 according to the embodiment sets the rotation cycle Ttt of the turntable 11 and/or the scanning cycle Tds of the dresser 51 so as to satisfy the following formula (1).

$$Ttt/Tds \neq \text{an integer and } Tds/Ttt \neq \text{an integer} \quad (1)$$

This is because, as described below, the dresser 51 may not dress the polishing pad 11*a* uniformly if Ttt/Tds or Tds/Ttt is an integer.

Figure 2A:
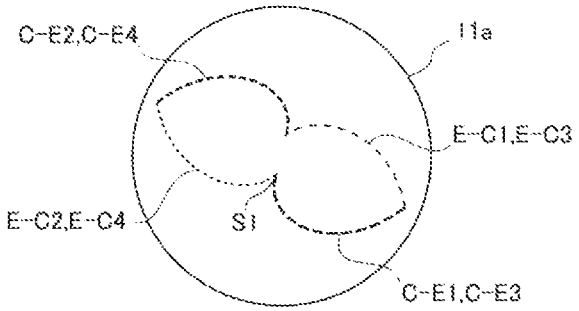
FIGS. 2A to 2C are views illustrating a locus of the dresser 51 on the polishing pad 11*a* in the case where Ttt/Tds or Tds/Ttt is an integer.
Figure 2B:
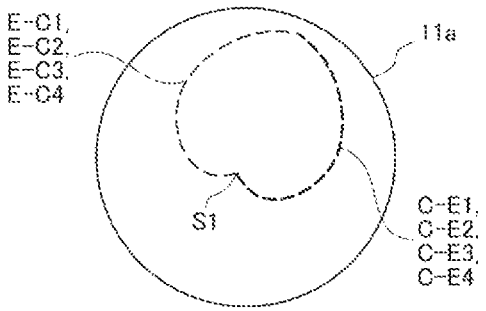
Figure 2C:
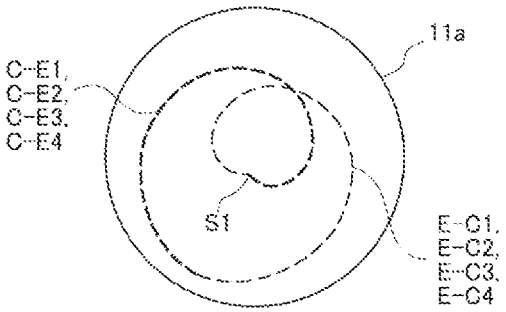

FIGS. 2A to 2C are views illustrating a locus of the dresser 51 on the polishing pad 11*a* in the case where Ttt/Tds or Tds/Ttt is an integer. FIGS. 2A to 2C illustrate a locus of the center of the dresser 51 on the polishing pad 11*a* in the case where the dresser 51 reciprocates four times between the center and an edge of the polishing pad 11*a* in each case where Ttt/Tds=2, 1, and 0.5. For example, "C-E1" in the drawings indicates the first locus from the center to the edge of the polishing pad 11*a*. Further, "E-C1" indicates the first locus from the edge to the center of the polishing pad 11*a*. The same applies to other symbols. A starting point of the dresser 51 is the center of the polishing pad 11*a* (exactly, an edge of the dresser 51 is positioned at the center of the polishing pad 11*a*).

As illustrated in the drawings, when Ttt/Tds or Tds/Ttt is an integer, the dresser 51 repeatedly moves in the same position on the polishing pad 11*a*. Specifically, in the case where Ttt/Tds=2, loci of first reciprocation and third reciprocation by the dresser 51 are the same, and loci of second reciprocation and fourth reciprocation are the same. Further, in the case where Ttt/Tds=1 and 0.5, loci of the first reciprocation to the fourth reciprocation by the dresser 51 are the same.

The reason why the loci are overlapped is that, for example, in the case where Ttt/Tds=1, when the turntable 11 rotates once, the dresser 51 reciprocates once and returns to an original position S1. More generally, in the case where Ttt/Tds=n (n is an integer), when the turntable 11 rotates once, the dresser 51 reciprocates n times and returns to the original position S1 on the polishing pad 11*a*. Further, in the case where Tds/Ttt=n, when the dresser 51 reciprocates once, the turntable 11 rotates n times, and the dresser 51 returns to the original position S1 on the polishing pad 11*a*.

As a result, in the case where Ttt/Tds or Tds/Ttt is an integer, a certain part of the polishing pad 11*a* is always scraped off, and the polishing pad 11*a* is not easily uniformed.

Figure 3A:
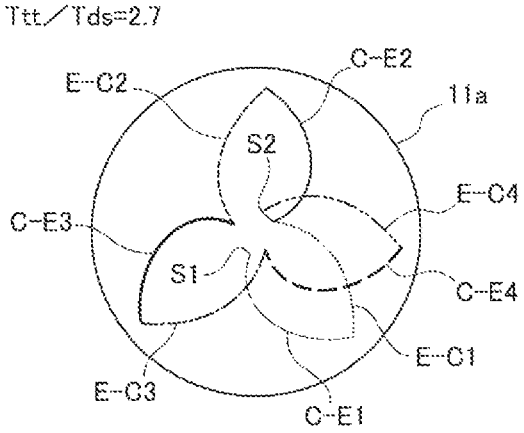
FIGS. 3A to 3C are views illustrating a locus of the dresser 51 on the polishing pad 11*a* in the case where Ttt/Tds and Tds/Ttt are non-integers.
Figure 3B:
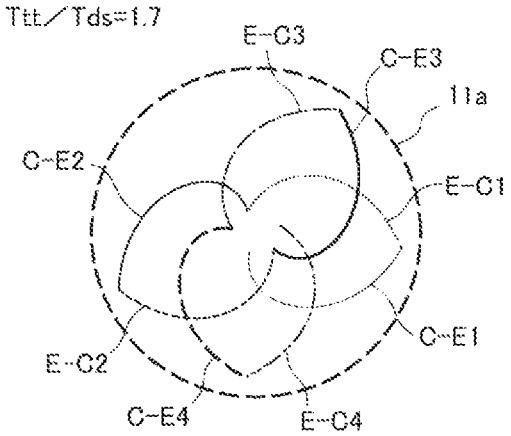
Figure 3C:
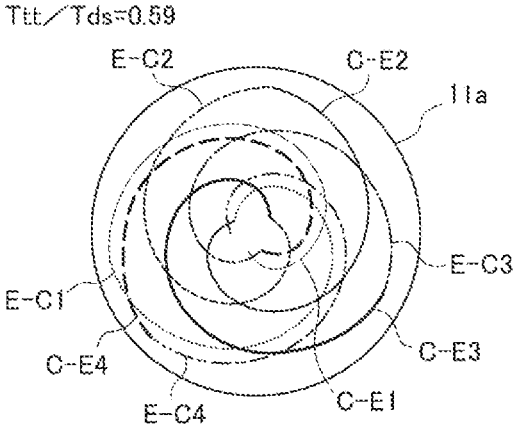

FIGS. 3A to 3C are views illustrating a locus of the dresser 51 on the polishing pad 11*a* in the case where Ttt/Tds and Tds/Ttt are non-integers. FIGS. 3A to 3C illustrate loci of the center of the dresser 51 on the polishing pad 11*a* in the case where the dresser 51 reciprocates four times between the center and the edge of the polishing pad 11*a* in each case where Ttt/Tds=2.7, 1.7, and 0.59. A starting point of the dresser 51 is the center of the polishing pad 11*a*.

In comparison between FIGS. 2A to 2C and FIGS. 3A to 3C, it is clarified that, in the case where Ttt/Tds and Tds/Ttt are non-integers, the dresser 51 moves at many positions on the polishing pad 11*a* without which loci overlap at least while reciprocating four times. FIGS. 2A to 2C and 3A to 3C indicate loci in the case of reciprocating four times. Many more positions on the polishing pad 11*a* can be dressed if the dresser 51 reciprocates five times or more.

The reason why the dresser 51 moves in many positions is that, for example, in the case where Ttt/Tds=1.7, the turntable 11 rotates 1/1.7 cycle when the dresser 51 reciprocates once, and the dresser 51 is positioned at a position S2 different from the original position S1. Thus, in the case where Ttt/Tds and Tds/Ttt are non-integers, until the dresser 51 returns to the original position S1 on the polishing pad 11*a*, reciprocation frequency of the dresser 51 and cycle frequency of the turntable 11 are increased.

As a result, when Ttt/Tds and Tds/Ttt are set to non-integers, many portions on the polishing pad 11*a* can be scraped, and the polishing pad 11*a* is uniformly dressed.

As described above, Ttt/Tds and Tds/Ttt are preferably set to non-integers. More preferably, when a scanning frequency of the dresser 51 for dressing once is set to N, the controller 6 may set the rotation cycle Ttt of the turntable 11 and the scanning cycle Tds of the dresser 51 such that the following formula (2) is satisfied.

$$Tds/Ttt = n + 1/N \quad (2)$$

Herein, n is any integer.

FIGS. 4A to 4C illustrate loci of the dresser 51 on the polishing pad 11*a* in the case where the above formula (2) is satisfied. FIGS. 4A to 4C illustrate loci of the center of the dresser 51 on the turntable 11 in the case where the dresser 51 reciprocates twice or four times between a center and an edge of the polishing pad 11*a* in each case where Tds/Ttt=1.5 (n=1, N=2), 2.5 (n=2, N=2), and 1.25 (n=1, N=4). A starting point of the dresser 51 is the center of the polishing pad 11*a*.

In the case where N=2 (FIGS. 4A and 4B), the dresser 51 does not return to the original position S1 of the polishing pad 11*a* until the dresser 51 reciprocates twice. Further, in the case where N=4 (FIG. 4C), the dresser 51 does not return to the original position S1 of the polishing pad 11*a* until the dresser 51 reciprocates four times.

More generally, the dresser 51 does not return to the original position S1 on the polishing pad 11*a* until the dresser 51 reciprocates N times. In other words, while reciprocating once to (N−1) times, the dresser 51 does not return to the original position S1 on the polishing pad 11*a*, and a locus is not overlapped. This is because, in the case where the relation of the above formula (2) is satisfied, when the turntable 11 rotates (nN+1) times, the dresser 51 reciprocates N times and returns to the original position S1.

Consequently, without scraping off a same portion on the polishing pad 11*a* while reciprocating N times, the polishing pad 11*a* can be efficiently dressed by limited reciprocating frequency.

Further, as more preferable other setting, when a radius of the dresser 51 is denoted by d, and a distance between a starting point of the dresser 51 and a center of the polishing pad 11*a* is denoted by r0, the controller 6 may set the rotation cycle Ttt of the turntable 11 and the scanning cycle Tds of the dresser 51 such that the following formula (3) is satisfied.

$$Tds/Ttt = n \pm d/2\pi r0 \quad (3)$$

Figure 5B:
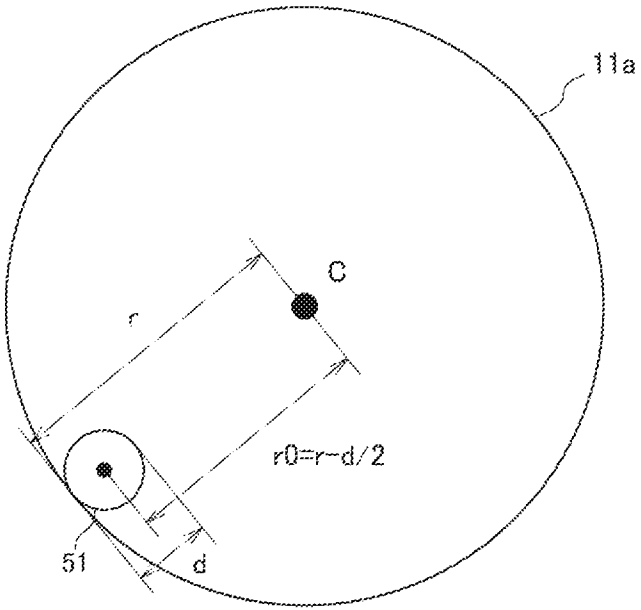
FIGS. 5A and 5B are views for describing the distance r0.
Figure 5A:
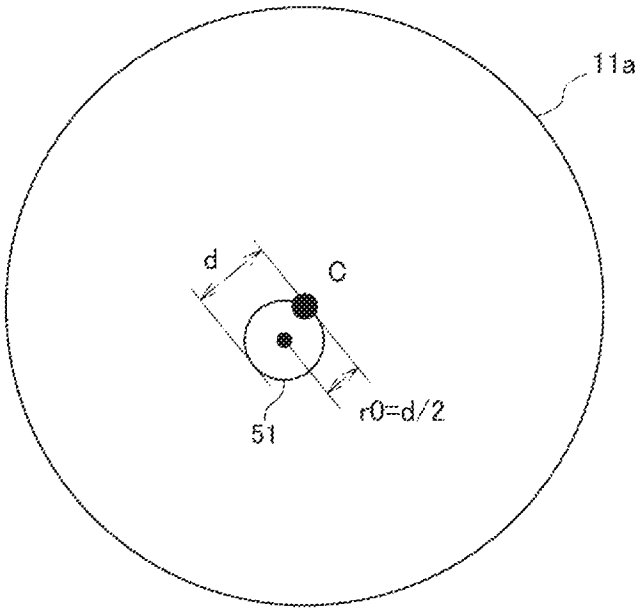

FIGS. 5A and 5B are views for describing the distance r0. As illustrated in FIG. 5A, in the case where a starting point of the dresser 51 is a center C of the polishing pad 11*a*, an edge of the dresser 51 is positioned on the center C of the polishing pad 11*a*, and therefore r0=d/2. As illustrated in FIG. 5B, in the case where a starting point of the dresser 51 is an edge of the polishing pad 11*a*, an edge of the dresser 51 is positioned on the edge of the polishing pad 11*a*, and therefore r0=r−d/2 (r is a radius of the polishing pad 11*a*).

Practically, the dresser 51 is often used by overhanging. This is because a polishing amount in an edge portion of the polishing pad 11*a* is likely to be insufficient under dresser scanning operation in which scanning is performed to the edge of the polishing pad 11*a*. In such a case, flatness of the polishing pad 11*a* is reduced, and when the reduced region is overlapped with a polished surface of the substrate W, polishing performance is adversely affected. Therefore, in the case where the dresser 51 is overhung at the edge of the polishing pad 11*a*, the distance r0 is preferably applied as a distance between an outer diameter of the overhung dresser 51 and a center of the polishing pad 11*a*.

FIGS. 6A and 6B illustrate loci of the dresser 51 on the polishing pad 11*a* in the case where the above formula (3) is satisfied. In FIGS. 6A and 6B, a starting point of the dresser 51 is a center (corresponding to FIG. 5A) of the polishing pad 11*a*. Then, d=100 [mm], and r0=50 [mm], and a right side second term in the formula (3) is $d/2\pi r0 \approx 0.32$. FIGS. 6A and 6B illustrate loci of the center of the dresser 51 on the polishing pad 11*a* in the case where the dresser 51 reciprocates four times between the center and an edge of the polishing pad 11*a* in each case where Tds/Ttt=1.32 (=1+0.32), and 1.68 (=2−0.32).

As illustrated in FIG. 6A, when the dresser 51 reciprocates once and returns to the center of the polishing pad 11*a*, the dresser 51 is positioned at the position S2 shifted forward from a locus of the dresser 51 by the distance d from the starting position S1 on the polishing pad 11*a*. Hereafter, every time the dresser 51 reciprocates once, the dresser 51 is shifted by the distance d.

As illustrated in FIG. 6B, when the dresser 51 reciprocates once and returns to a center of the polishing pad 11*a*, the dresser 51 is positioned at a position S3 shifted backward from a locus of the dresser 51 by the distance d from the starting position S1 on the polishing pad 11*a*. Hereafter, every time the dresser 51 reciprocates once, the dresser 51 is shifted by the distance d.

Thus, the dresser 51 reciprocates while shifting by its diameter d. Therefore, an undressed region can be decreased in a circumferential direction of the polishing pad 11*a*. Especially, by setting a starting point of the dresser 51 to a center of the polishing pad 11*a*, the dresser 51 can thoroughly dress near a center of the polishing pad 11*a*.

Although a starting point of the dresser 51 may be set to an edge of the polishing pad 11*a*, in such a case, a value of a circumference $2\pi r0$ is increased in comparison with the distance d, the dresser 51 needs to reciprocate many times to rotate the circumference $2\pi r0$ once while shifting by the distance d. Accordingly, the scanning mechanism 56 preferably swings the dresser 51 from near a center of the polishing pad 11*a* as a starting point.

In order to reduce an undressed region in a radial direction of the polishing pad 11*a*, the dresser 51 preferably moves in the radial direction while shifting by the diameter d every time the turntable 11 rotates once. Specifically, when an average of a reciprocation speed of the dresser 51 is denoted by Vds [mm/s], in addition to conditions of the above formula (1) to (3), the following formula (4) is preferably further satisfied.

$$Vds=d/Ttt \tag{4}$$

The controller 6 preferably sets the rotation cycle Ttt of the turntable 11 and/or the scanning cycle Tds of the dresser 51 so as to satisfy not only any of the above (1) to (3) but also the above formula (4). For example, the controller 6 may choose n in the formulas (2) and (3) such that the average scanning speed Vds comes closest to d/Ttt.

Further, a swinging distance of the dresser 51 (moving distance in one reciprocation) is set to L [mm] (determined by a length of the dresser arm 55 and a swing angle in FIG. 1), and if acceleration and deceleration of the dresser 51 is ignored, the average scanning speed Vds of the dresser 51 is indicated by the following formula (5).

$$Vds=L/Tds \tag{5}$$

The following formula (6) is derived from the above formulas (4) and (5).

$$Tds/Ttt=L/d \tag{6}$$

The general dresser 51 can be exchanged. Therefore, the controller 6 sets the rotation cycle Ttt of the turntable 11 and/or the scanning cycle Tds of the dresser 51 such that any of the above formulas (1) to (3) are satisfied, and also the dresser 51 having the diameter d satisfying the above formula (6) may be used. Accordingly, the following formula (4) is satisfied.

As described above, parallel processing and serial processing are considered as a dressing timing. In the above formulas (1) to (3), the rotation cycle Ttt of the turntable 11 and the scanning cycle Tds of the dresser 51 may be controlled. However, as described below, in the case of the parallel processing, setting flexibility of the scanning cycle Tds of the dresser 51 is increased. In the case of the serial processing, setting flexibility of the rotation cycle Ttt of the turntable 11 is increased.

In the case of the serial processing, a dressing period, in other words, a period between polishing the substrate Wand polishing the following substrate W is overhead time, and therefore, the period cannot be much extended. Specifically, this period is for about 12 to 16 seconds. In this short period, the dresser 51 needs to reciprocate plural times. Otherwise, the dresser 51 cannot sufficiently dress the polishing pad 11*a*. Under these restrictions, the controller 6 sets the rotation cycle Ttt of the turntable 11 and/or the scanning cycle Tds of the dresser 51 so as to satisfy any of the above formulas (1) to (3).

Specifically, when the above-described dressing period is denoted by T0, and a minimum reciprocation frequency of the dresser 51 is denoted by m, the controller 6 sets the scanning cycle Tds of the dresser 51 so as to satisfy the formula (7).

$$Tds \leq T0/m \tag{7}$$

In other words, to cause the dresser 51 to reciprocate m times or more, the controller 6 cannot extremely largely set the scanning cycle Tds of the dresser 51, and an upper limit value T0/m of the scanning cycle Tds exists based on the above formula (7).

On the other hand, the substrate W is not polished during dressing. Therefore, the rotation cycle Ttt of the turntable 11 is not limited so much. Therefore, the controller 6 first can set the scanning cycle Tds of the dresser 51 so as to satisfy the above formula (7), and then set the rotation cycle Ttt of the turntable 11 so as to satisfy any of the above formulas (1) to (3).

However, if the rotation cycle Ttt is excessively shortened, the dresser 51 floats due to dressing liquid supplied from the dressing liquid supply nozzle 4 (called a hydroplaning phenomenon), and the polishing pad 11*a* may not be polished. Therefore, the rotation cycle Ttt needs to be set within a range in which the hydroplaning phenomenon is not occurred.

In the case of parallel processing, the substrate W is also polished during dressing. Therefore, the rotation cycle Ttt of the turntable 11 is determined under a polishing condition of the substrate W, and it is difficult to set the rotation cycle for dressing convenience. On the other hand, the dressing period is not needed to be shortened, and therefore, the scanning cycle Tds of the dresser 51 is not significantly limited. Therefore, the controller 6 can set the scanning cycle Tds of the dresser 51 so as to satisfy any of the above formulas (1) to (3), with respect to the rotation cycle Ttt of the turntable 11 determined under the polishing condition of the substrate W.

The controller 6 cannot set the reciprocation cycle Ts of the dresser 51 extremely small even in the case of the serial processing and the parallel processing. This is because, in accordance with the scanning mechanism 56, more specifically in accordance with ability of the swinging motor driver 562 and the swinging motor 563, a moving speed of the dresser 51 is limited.

Figure 7:
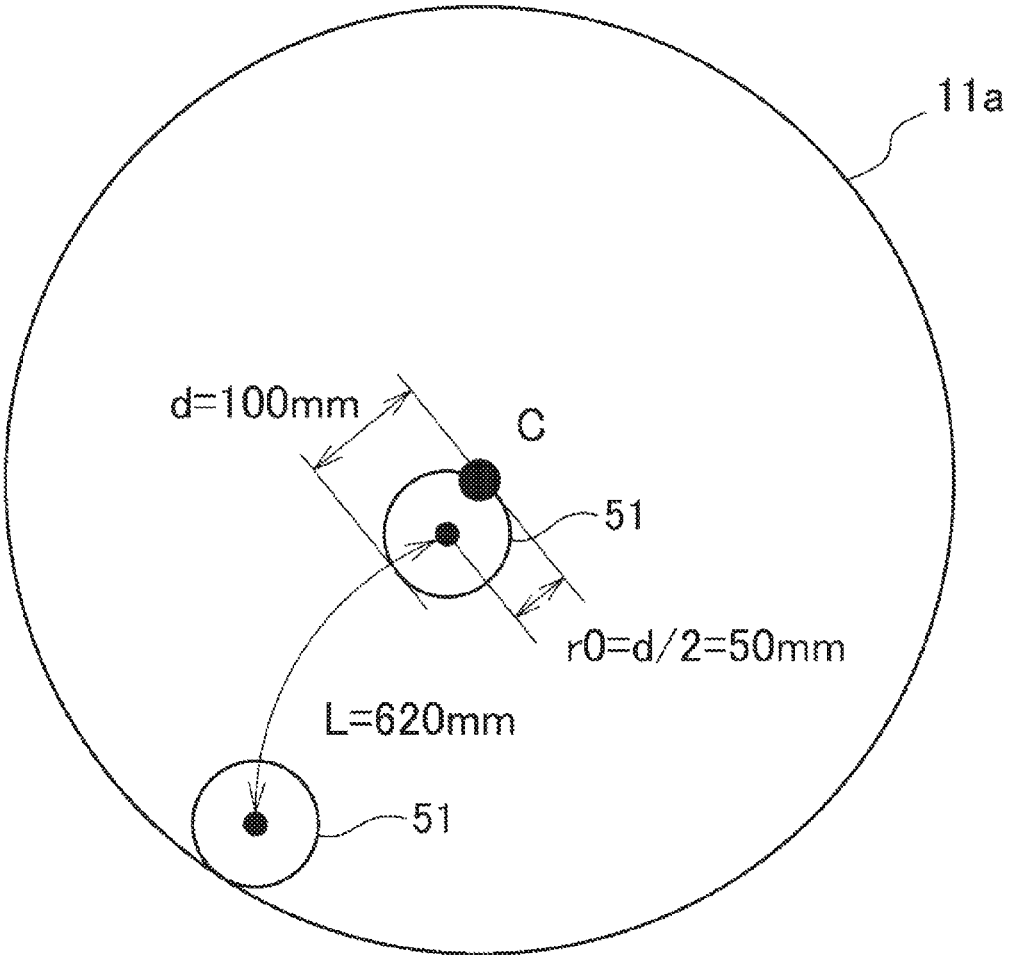
FIG. 7 is a view for describing a specific example for calculating a dressing condition.

A specific example will be described below with referent to FIG. 7. In the example, it is assumed that the diameter d of the dresser 51 is 100 [mm], the rotation cycle Ttt of the turntable 11 is 0.666 [s], a distance r0 between a starting point of the dresser 51 (a center of the polishing pad 11*a*) and a center of the polishing pad 11*a* is 50 [mm], and that a reciprocation distance L of the dresser 51 is 620 [mm]. In this situation, the scanning cycle Tds of the dresser 51 satisfying the above formula (3) will be calculated.

When these values are assigned in the above formula (3), the following formulas (3') and (3") are established.

$$Tds=Ttt(n+d/2\pi r0)\approx 0.666(n+0.3188)\approx 3.54,4.21,4.87\ [s]\ (n=5,6,7) \quad (3')$$

$$Tds=Ttt(n-d/2\pi r0)\approx 0.666(n-0.3188)\approx 3.12,3.78,4.45\ [s]\ (n=5,6,7) \quad (3")$$

Herein, further the scanning cycle Tds of the dresser 51 satisfying the above formula (4) will be considered. When the above assumed values are assigned in the above formula (4), the following formulas (4') is established.

$$Vds=d/Ttt\approx 150\ [mm/s] \quad (4')$$

Further, when acceleration/deceleration of the dresser 51 is ignored, and the values and a result of the above formula (4') are assigned in the above formula (5), the following formula (5') is established.

$$Tds=L/Vds\approx 4.133\ [s] \quad (5')$$

To improve accuracy, acceleration/deceleration of the dresser 51 is considered. If an acceleration at a center and an edge of the polishing pad 11*a* is set to 500 mm/s$^2$, a time needed to reach the scanning speed Vds=150 [mm/s] of the above dresser 51 is 0.3 [s]. The acceleration occurs four times in one reciprocation. Therefore, a total time of the acceleration is 1.2 [s]. Therefore, the scanning cycle Tds of the dresser 51 is expressed by the following formula (5").

$$Tds(L-(Vds*\text{total acceleration time}/2))/Vds+\text{total acceleration time}=(620-(150*1.2)/2)/150+1.2=4.73\ [s] \quad (5")$$

Therefore, a value close to this value 4.73 [s] is 4.87 (n=7) by the above formula (3'). Therefore, it is appropriate that the controller 6 sets the scanning cycle Tds of the dresser 51 to 4.87 [s]. Tds/Ttt=4.87/0.666=7.31, which is a non-integer.

Thus, in the first embodiment, the rotation cycle Ttt of the turntable 11 and the scanning cycle Tds of the dresser 51 are set such that Tds/Ttt and Ttt/Tds become non-integers during dressing. Therefore, many positions on the polishing pad 11*a* can be dressed, and the polishing pad 11*a* is uniformly dressed.

Second Embodiment

In the above-described first embodiment, it is focused on that loci of the dresser 51 are not overlapped, in other words, as many positions as possible on the polishing pad 11*a* are polished. On the other hand, in the second embodiment to be described next, fluctuation of a polishing amount of the polishing pad 11*a* is reduced depending on a position of the dresser 51.

The polishing amount of the polishing pad 11*a* by the dresser 51 per unit time (hereinafter simply called a polishing rate) is proportional to a relative speed V between the dresser 51 and the polishing pad 11*a*. In the embodiment, the relative speed V at a center of the dresser 51 is considered assuming that the dresser 51 is sufficiently smaller than the turntable 11. Further, if it is assumed that a friction coefficient between the dresser 51 and the polishing pad 11*a* is constant, the polishing rate is proportional to a pressing force F of the dresser 51 with respect to the polishing pad 11*a*. As a result, the polishing rate is proportional to the product of the relative speed V and the pressing force F.

On the other hand, a time period when the dresser 51 polishes a position on the polishing pad 11*a* (hereinafter, simply called a polishing time) is inversely proportional to a speed on the position on the polishing pad 11*a*. This speed is proportional to a distance r from a center of the polishing pad 11*a* to the position on the polishing pad 11*a* (specifically, a position in which the dresser 51 is positioned). As a result, the polishing time is inversely proportional to the distance r between the dresser 51 and a center of the polishing pad 11*a*.

The above-described relative speed V, the pressing force F, and the distance r can be changed in every moment, and therefore each value at the time t is denoted by V(t), F(t), and r(t).

An amount in which the dresser 51 polishes a position on the polishing pad 11*a* (hereinafter simply called a polishing amount) is the product of the polishing rate and the polishing time. As described above, the polishing amount is proportional to the product of the relative speed V(t) and the pressing force F(t) and inversely proportional to the distance r (t). Therefore, in the embodiment, the controller 6 controls so as to satisfy the following formula (7) such that the polishing amount becomes constant regardless of a position of the dresser 51 (specifically the time t).

$$V(t)F(t)/r(t)=\text{constant} \quad (7)$$

It is difficult to control the distance r(t). Therefore, the controller 6 controls the relative speed V(t) and/or the pressing force F(t) so as to satisfy the above formula (7).

In the embodiment, the relative speed V(t) at a center of the dresser 51 is considered. Therefore, the relative speed V(t) is determined by a speed of the turntable 11 (specifically $2\pi r(t)/Ttt=2\pi r(t)*Ntt/60$) and a scanning speed Vds [mm/s] of the dresser 51. Therefore, in the case where the controller 6 controls the relative speed V(t), the rotation speed Ntt of the turntable 11 and/or the scanning speed Vds of the dresser 51 may be adjusted.

However, in the embodiment, the dresser 51 reciprocates in an arc shape, not linearly, between a center and an edge of the polishing pad 11*a*, the scanning speed Vds of the dresser 51 includes not only a radial direction component but also a circumferential direction component. In such a case, the controller 6 preferably adjusts the rotation speed Ntt of the turntable 11, not the scanning speed Vds of the dresser 51.

In the case where a rotation direction of the turntable 11 and the circumferential direction component of the scanning speed Vds of the dresser 51 are matched, the relative speed V(t) is reduced, and the polishing rate is reduced. When the scanning speed Vds of the dresser 51 is reduced to extend the polishing time, the number of times for reciprocating on the polishing pad 11*a* is reduced, and the dresser 51 cannot sufficiently dress on the polishing pad 11*a*. Therefore, preferably, the scanning speed Vds of the dresser 51 is set to be constant to satisfy the above formula (7), and the controller 6 adjusts the rotation speed Ntt of the turntable 11.

Further, in the case where a rotation direction of the turntable 11 and a circumferential direction component of the scanning speed Vds of the dresser 51 are in the opposite direction, the relative speed V(t) is increased. Therefore, the polishing rate is increased. If the scanning speed Vds of the dresser 51 is increased to shorten the polishing time, the relative speed V(t) is further increased. Therefore, the scanning speed Vds of the dresser 51 is also set to be constant to satisfy the above formula (7), and the controller 6 preferably adjusts the rotation speed Ntt of the turntable 11.

Therefore, as an example of the control to satisfy the above formula (7), the controller 6 sets the pressing force F (t) constant, and in accordance with the distance r(t), the rotation speed Ntt of the turntable 11 is adjusted at any time. In this case, as dressing timing, a serial processing is preferably applied. This is because in parallel processing, the rotation speed Ntt of the turntable 11 is determined under a polishing condition, and thus it is difficult to set the rotation speed for dressing convenience.

Further, as another example of the control to satisfy the above formula (7), the controller 6 sets the rotation speed Ntt of the turntable 11 constant, and the pressing force F(t) is adjusted in accordance with the distance r(t). In this case, as dressing timing, both serial processing and parallel processing are applicable.

Since a contact area between the dresser 51 and the polishing pad 11*a* is constant, the pressing force F(t) is proportional to a pressure P(t) of the dresser 51 with respect to the polishing pad 11*a*. Therefore, in the above formula (7), the pressure P(t) may be used instead of the pressing force F(t).

In this manner, in the second embodiment, control is performed such that V(t F(t)/r(t) becomes constant. Therefore, the polishing amount of the polishing pad 11*a* can be constant regardless of a position of the dresser 51.

The embodiment may be combined with the first embodiment. Specifically, the control is performed so as to satisfy any of the formulas (1) to (3) (in some cases, also the above formula (4)) is satisfied) and to make V(t)F(t)/r(t) constant.

Third Embodiment

In the above-described second embodiment, it is assumed that a friction coefficient between the dresser 51 and the polishing pad 11*a* are constant. However, the friction coefficient can fluctuate actually. In the third embodiment to be described next, control is performed in consideration of fluctuation of the friction coefficient.

In general, a friction coefficient between two objects is fluctuated in accordance with a relative speed therebetween and a pressing force of each other. This relation is called a Stribeck curve. In the embodiment, a friction coefficient z between the dresser 51 and the polishing pad 11*a* fluctuates in accordance with a relative speed V and a pressing force F of the dresser 51 with respect to the polishing pad 11*a*.

Figure 8:
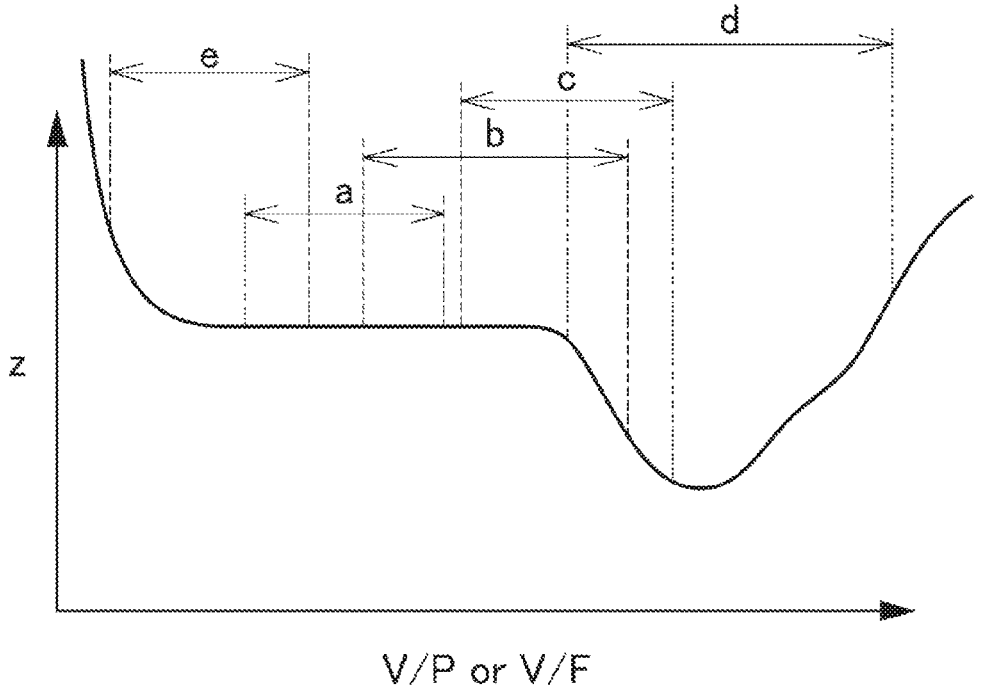
FIG. 8 is a view schematically illustrating the Stribeck curve.

FIG. 8 is a view schematically illustrating the Stribeck curve. A horizontal axis is a ratio V/F between the relative speed V and the pressing force F, and a vertical axis is a friction coefficient z. As described in the drawing, there are a region "a" in which the friction coefficient z is almost constant regardless of the ratio V/F and regions "b" to "e" in which the friction coefficient z fluctuates in accordance with the ratio V/F. If the dresser 51 operates in the region "a", the friction coefficient z is constant even if the relative speed V fluctuates depending on a position of the dresser 51. Therefore, the controller 6 monitors a relation between the friction coefficient z and the ratio V/F, and the controller 6 adjusts the relative speed V and/or the pressing force F such that the dresser 51 operates in the region "a". This relation is monitored as described below, and the controller 6 may display this relation on a display (not illustrated).

The pressing force F(t) is obtained from the product of a pressure P supplied to the cylinder 532 from the electro-pneumatic regulator 531 and the area of the cylinder 532 (alternatively, from a load cell (not illustrated) provided on an axis between the dresser 51 and the cylinder 532). The pressing force F and the above pressure P are proportional. Therefore, instead of the pressing force F, the pressure P may be used in a state as described above.

In the embodiment, the relative speed V(t) at a center of the dresser 51 is considered. Therefore, the relative speed V is determined by a speed of the turntable 11 (namely, $2\pi r(t)/Ttt=2\pi r(t)*Ntt/60$, and r(t) is a distance between the dresser 51 and a center of the polishing pad 11*a*) and the scanning speed Vds of the dresser 51 (namely, L/Tds, and L is a swinging distance during one reciprocation by the dresser 51). The rotation speed Ntt of the turntable 11 and the scanning cycle Tds of the dresser 51 can be controlled by the controller 6, and therefore, the controller 6 can grasp them. A reciprocation distance L of the dresser 51 is known. The distance r(t) is detected by a detector of the scanning mechanism 56.

The friction coefficient z is a ratio f/F between the pressing force F and a force f for which the dresser 51 actually polishes the polishing pad 11*a*. The polishing force f is almost equal to a horizontal direction force Fx acting on the polishing pad 11*a*. Therefore, the friction coefficient z can be obtained by dividing the torque of the turntable 11 by dressing (difference between torque Tr of the turntable 11 and steady torque Tr0 in the case where the dresser 51 does not contact to the polishing pad 11*a*) by the distance r. Herein the torque Tr is obtained by multiplying a driving current I detected by a current detector 123 and torque constant Km[Nm/A] unique to the turntable motor 122.

As described above, the friction coefficient z can be monitored by obtaining the friction coefficient z, the relative speed V(t), and the pressing force F for each time t. The controller 6 can grasp which region in a Stribeck curve the dresser 51 is operating. Therefore, in the case where the dresser 51 operates in the regions "b" to "e", the controller 6 can control the pressing force F (or a pressure P) and/or the relative speed V(t) such that the dresser 51 operates in the region "a". As a result, a friction coefficient between the dresser 51 and the polishing pad 11*a* becomes constant, and thus the polishing pad 11*a* can be uniformly dressed.

Fourth Embodiment

A controller 6 according to the fourth embodiment controls a turntable 11 and a dresser 51 under conditions set in any of the first to third embodiments. However, to prevent friction between the dresser 51 and the polishing pad 11*a*, the controller 6 causes the turntable 11 and the dresser 51 to operate in a state in which the dresser 51 is disposed over the polishing pad 11*a* without coming into contact thereto. This is called "air recipe".

The above condition is a condition obtained by calculation. However, actually, the turntable 11 and the dresser 51 sometimes cannot operate in accordance with the conditions due to a hardware restriction and a communication speed of a polishing apparatus and software processing. Therefore, the controller 6 causes the turntable 11 and the dresser 51 to operate by using the air recipe and regularly obtains the actual rotation speed Ntt of the turntable 11, the actual scanning speed Vds of the dresser 51, and the position r of the dresser 51. Based on these values, the controller 6 calculates a locus of the dresser 51 on the polishing pad 11*a* as illustrated in FIGS. 2A to 4C and 6A to 6B. This lotus may be displayed on a display.

It is determined based on this lotus whether the polishing pad 11*a* is uniformly dressed. This determination may be performed by hand or by the controller 6.

Thus, in the embodiment, the controller 6 causes the turntable 11 and the dresser 51 to operate by using the air recipe. Therefore, it is possible to confirm whether the polishing pad 11*a* can be uniformly dressed when operating under the set condition without wearing the turntable 11 and the dresser 51.

Fifth Embodiment

A controller 6 according to a fifth embodiment performs self-control. The controller 6 according to the embodiment previously stores, in a database, a dressing condition in which a polishing pad 11*a* is uniformly polished and a dressing condition in which the polishing pad 11*a* is not uniformly dressed. The former condition is a condition, for example, which satisfies the above formulas (1) to (3) and in which a good result is obtained as a result of the confirmation described in the fourth embodiment. The latter condition is a condition, for example, which does not satisfy the above formulas (1) to (3) and in which a good result cannot be obtained as a result of the confirmation described in the fourth embodiment even if the formulas are satisfied.

The dressing condition herein is, for example, a rotation cycle Ttt of the turntable 11, a scanning cycle Tds of the dresser 51, a scanning speed Vds of the dresser 51, a pressing force F(t), and a pressure P(t), or a relation among them.

Figure 9:
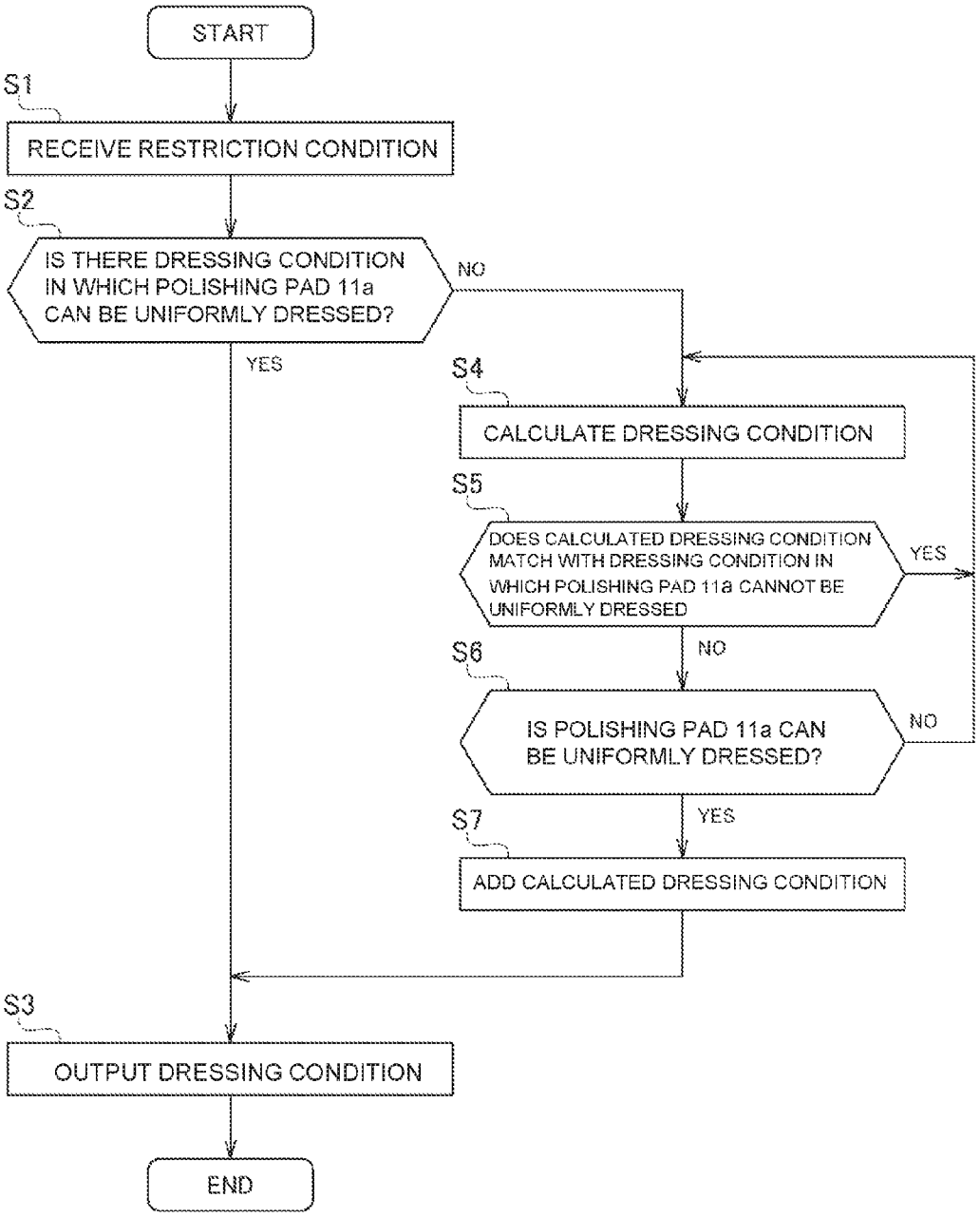
FIG. 9 is a flowchart illustrating an example of a process operation of the controller 6 according to the fifth embodiment.

FIG. 9 is a flowchart illustrating an example of a process operation of the controller 6 according to the fifth embodiment. The controller 6 receives a restriction condition for setting a dressing condition (step S1). The restriction condition is, for example, a rotation speed Ntt of the turntable 11 and a machine constant of a polishing apparatus (such as a maximum scanning speed Vds of the dresser 51) in the case of performing serial processing.

Next, the controller 6 refers to a database and confirms whether there is a dressing condition which satisfies the restriction condition and in which the polishing pad 11*a* can be uniformly dressed (step S2).

If there is the condition (YES in step S2), the controller 6 outputs the dressing condition (step S3).

If there is not (NO in step S2), the controller 6 calculates a dressing condition by the method according to the above-described first to third embodiments (step S4). Then, the controller 6 refers to the database and confirms whether the calculated result and the dressing condition in which the polishing pad 11*a* cannot be uniformly dressed are matched (step S5). If matched (YES in step S5), the controller 6 calculates another dressing condition (step S4). If not, the confirmation described in the fourth embodiment is performed (step S6).

Based on the obtained locus of the dresser 51, in the case where it is determined that the polishing pad 11*a* cannot be uniformly dressed (NO in step S6), another dressing condition is calculated (step S4).

Based on the obtained locus of the dresser 51, in the case where it is determined that the polishing pad 11*a* can be uniformly dressed (YES in step S6), the controller 6 adds the dressing condition calculated in step S4 to the database (step S7) and outputs the condition from the database (step S3).

After confirmation by using the air recipe in step S6, it can be confirmed by further performing actual dressing whether the polishing pad 11*a* can be uniformly dressed. Further, needless to say, the flowchart illustrated in FIG. 9 can be appropriately changed such as omitting a part of step.

In this manner, in the fifth embodiment, the controller 6 performs self-control. Therefore, a dressing condition capable of efficiently uniformly dressing the polishing pad 11*a* can be obtained.

The above-described embodiments are described for the purpose of performing the present invention by a person having a general knowledge in the technical field to which the present invention belongs. Various variations of the above embodiments can be applied by a person having ordinary skill in the art, and a technical idea of the present invention can be applied to other embodiments. Therefore, the present invention is not limited to the described embodiments, and should be within the widest range in accordance with a technical idea defined by the scope of the claims.

What is claimed is:

1. A polishing apparatus comprising:

a turntable for supporting a polishing pad;

a turntable rotation mechanism configured to rotate the turntable;

a dresser configured to dress the polishing pad; and a scanning mechanism configured to cause the dresser to scan between a first position and a second position on the polishing pad, wherein Ttt/Tds and Tds/Ttt are a non-integer where the Ttt is a rotation cycle of the turntable during dressing, and the Tds is a scanning cycle during which the dresser scans between the first position and the second position.

2. The polishing apparatus according to claim 1, further comprising a controller configured to set the Ttt and/or the Tds.

3. The polishing apparatus according to claim 1, wherein Tds/Ttt=n+1/N (n is any integer) is satisfied where the N is a number of times for which the dresser scans on the polishing pad during dressing once.

4. The polishing apparatus according to claim 1, wherein Tds/Ttt=n±d/2πr0 is established (n is any integer) where the d is a diameter of the dresser, and the r0 is a distance from a starting point of the dresser in scanning to a center of the turntable.

5. The polishing apparatus according to claim 3, wherein in a case where a diameter of the dresser is denoted by d, the n is selected such that an average scanning speed of the dresser is closest to d/Ttt.

6. The polishing apparatus according to claim 1, wherein the dresser dresses the polishing pad during a period after polishing one substrate is completed and before a next substrate is started to be polished, and the Tds is set such that the dresser scans on the polishing pad for first times or more during the period.

7. The polishing apparatus according to claim 1, wherein the dresser dresses the polishing pad in parallel with polishing the substrate, and the Ttt is set in accordance with a polishing condition of the substrate.

8. The polishing apparatus according to claim 1, wherein the scanning mechanism causes the dresser to scan from a neighborhood of a center on the polishing pad as a starting point.

9. The polishing apparatus according to claim 1, further comprising a pressing mechanism configured to press the dresser against the polishing pad, wherein V(t)A(t)/r(t) is substantially constant where the V(t) is a relative speed between the dresser and the polishing pad at a time t, the r(t) is a distance between a center of the turntable and a center of the dresser at a time t, and the A(t) is a pressing force or a pressure of the dresser against the polishing pad at a time t.

10. The polishing apparatus according to claim 9, further comprising a controller configured to control the V(t) and/or the A(t) such that V(t)A(t)/r(t) becomes substantially constant.

11. The polishing apparatus according to claim 9, further comprising a controller configured to control the V(t) and/or the A(t) such that a friction coefficient between the dresser and the polishing pad becomes constant.

12. The polishing apparatus according to claim 11, wherein the controller calculates the friction coefficient based on the V(t), the A(t), and a force to actually dress the polishing pad by the dresser.

13. A polishing apparatus comprising:

a turntable for supporting a polishing pad;

a turntable rotation mechanism configured to rotate the turntable;

a dresser configured to dress the polishing pad;

a pressing mechanism configured to press the dresser against the polishing pad; and a scanning mechanism configured the dresser to scan between a first position and a second position of the polishing pad, wherein V(t)A(t)/r(t) is substantially constant where the V(t) is a relative speed between the dresser and the polishing pad at a time t, the r(t) is a distance between a center of the turntable and a center of the dresser at a time t, and the A(t) is a pressing force or a pressure of the dresser against the polishing pad at a time t.

14. The polishing apparatus according to claim 13, further comprising a controller configured to control the V(t) and/or the A(t) such that V(t)A(t)/r(t) becomes substantially constant.

15. The polishing apparatus according to claim 13, further comprising a controller configured to control the V(t) and/or the A(t) such that a friction coefficient between the dresser and the polishing pad becomes constant.

16. The polishing apparatus according to claim 15, wherein the controller calculates the friction coefficient based on the V(t), the A(t), and a force to actually dress the polishing pad by the dresser.

17. The polishing apparatus according to claim 13, further comprising a controller configured to rotate the turntable by controlling the turntable rotation mechanism and cause the dresser to scan by controlling the scanning mechanism in a state in which the dresser does not come into contact with the polishing pad, to monitor a locus of the dresser on the polishing pad in a state in which the dresser does not come into contact with the polishing pad.

18. A control method for a polishing apparatus, said method comprising:

providing a turntable for supporting a polishing pad, a turntable rotation mechanism, a dresser, a scanning mechanism, and a controller; and controlling the turntable rotation mechanism and the scanning mechanism such that Ttt/Tds and Tds/Ttt become non-integers in a case where a rotation cycle of the turntable during dressing is denoted by Ttt, and a scanning cycle in which the dresser scans between a first position and a second position on the polishing pad is denoted by Tds.

19. A control method for a polishing apparatus, said method comprising:

providing a turntable for supporting a polishing pad, a turntable rotation mechanism, a dresser, a pressing mechanism, a scanning mechanism, and a controller; and controlling the turntable rotation mechanism, the pressing mechanism, and the scanning mechanism such that V(t)A(t)/r(t) becomes substantially constant where the V(t) is a relative speed between the dresser and the polishing pad at a time t, the r(t) is a distance between a center of the turntable and a center of the dresser at a time t, and the A(t) is a pressing force or a pressure of the dresser against the polishing pad at a time t.

20. A dressing condition output method for a polishing apparatus, said method comprising:

preparing a turntable for supporting a polishing pad, a turntable rotation mechanism a dresser, a scanning mechanism, and a controller;

receiving a restriction condition;

first referring to a database previously storing a first condition which is a dressing condition capable of uniformly dressing the polishing pad and a second condition which is a dressing condition incapable of uniformly dressing the polishing pad, and outputting the first condition in a case where the first condition satisfying the restriction condition is stored in the database;

calculating a dressing condition in a case where the first condition satisfying the restriction condition is not stored; and second referring to the database to output the calculated dressing condition in a case where the calculated dressing condition and the second condition are not matched, wherein, upon calculating the dressing condition, the dressing condition is calculated such that Ttt/Tds and Tds/Ttt become non-integers where the Ttt is a rotation cycle of the turntable during dressing, and the Tds is a scanning cycle during which the dresser scans between a first position and a second position on the polishing pad.

21. The dressing condition output method according to claim 20, further comprising adding the calculated dressing condition to the database in a case where the calculated dressing condition and the second condition are not matched.

22. The dressing condition output method according to claim 20, further comprising, in a case where the calculated dressing condition and the second condition are not matched, rotating the turntable by controlling the turntable rotation mechanism and causing the dresser to scan by controlling the scanning mechanism in a state in which the dresser does not come into contact with the polishing pad and under the calculated dressing condition, to confirm by monitoring a locus of the dresser on the polishing pad whether or not dressing the polishing pad uniformly is possible, wherein if possible to dress the polishing pad uniformly as a result of a confirmation, the controller outputs the calculated dressing condition.

23. The dressing condition output method according to claim 20, further comprising calculating other dressing condition in a case where the calculated dressing condition and the second condition are matched.

24. A method for outputting a dressing condition for a polishing apparatus, said method comprising:

supplying a turntable for supporting a polishing pad, a turntable rotation mechanism, a dresser, a pressing mechanism, a scanning mechanism, and a controller; and receiving a restriction condition;

first referring to a database preliminary storing the first condition which is a dressing condition capable of uniformly dressing the polishing pad and a second condition which is a dressing condition incapable of uniformly dressing the polishing pad, and outputting a first condition in a case where the first condition satisfying the control condition is stored in the database;

calculating a dressing condition in a case where the first condition satisfying the restriction condition is not stored; and second referring to the database to output the calculated dressing condition in a case where the calculated dressing condition and the second condition are not matched, wherein, upon calculating the dressing condition, the dressing condition is calculated such that $V(t)A(t)/r(t)$ becomes substantially constant where the $V(t)$ is a relative speed between the dresser and the polishing pad at a time t, the $r(t)$ is a distance between a center of the turntable and a center of the dresser at a time t, and the $A(t)$ is a pressing force or a pressure of the dresser against the polishing pad at a time t.

25. The method for outputting a dressing condition according to claim 24, further comprising adding the calculated dressing condition to the database in a case where the calculated dressing condition and the second condition are not matched.

26. The method for outputting a dressing condition according to claim 24, further comprising, in a case where the calculated dressing condition and the second condition are not matched, rotating the turntable by controlling the turntable rotation mechanism and causing the dresser to scan by controlling the scanning mechanism in a state in which the dresser does not come into contact with the polishing pad and under the calculated dressing condition, to confirm by monitoring a locus of the dresser on the polishing pad whether or not dressing the polishing pad uniformly is possible, wherein if possible to dress the polishing pad uniformly as a result of a confirmation, the controller outputs the calculated dressing condition.

27. The method for outputting a dressing condition according to claim 24, further comprising calculating other dressing condition in a case where the calculated dressing condition and the second condition are matched.

* * * * *